United States Patent [19]

Kaup et al.

[11] 3,962,059

[45] June 8, 1976

[54] PROCESS AND DEVICE FOR ELECTROPHORETICALLY PLATING METAL PARTS

[75] Inventors: Friedel Kaup, Gutersloh; Heinrich Warnke, Marienfeld, both of Germany

[73] Assignee: Miele & Cie., Guttersloh, Germany

[22] Filed: Jan. 6, 1975

[21] Appl. No.: 538,476

[30] Foreign Application Priority Data

Jan. 8, 1974 Germany ..... 2400705

[52] U.S. Cl. ..... 204/181; 204/299 EC

[51] Int. Cl.[2] ..... C25D 13/02

[58] Field of Search ..... 204/181, 299 EC, 275, 204/276, 300 EC, 180 P

[56] References Cited

UNITED STATES PATENTS

| | | | |
|---|---|---|---|
| 3,616,396 | 10/1971 | Swanson | 204/181 |
| 3,730,866 | 5/1973 | Madejczyk | 204/181 |
| 3,850,773 | 11/1974 | Lupinski et al. | 204/181 |
| 3,865,706 | 2/1975 | Cooke | 204/181 |

*Primary Examiner*—Howard S. Williams
*Attorney, Agent, or Firm*—Allison C. Collard

[57] ABSTRACT

Process and device for electrophoretically plating metal parts with vitreous enamel in a plating vessel containing a hollow cathode whose interior is connected by openings with its outside, the openings being covered by a membrane, the hollow cathode being completely emptied of water and other liquids by means of a pump or drain.

8 Claims, 6 Drawing Figures

Fig. 3
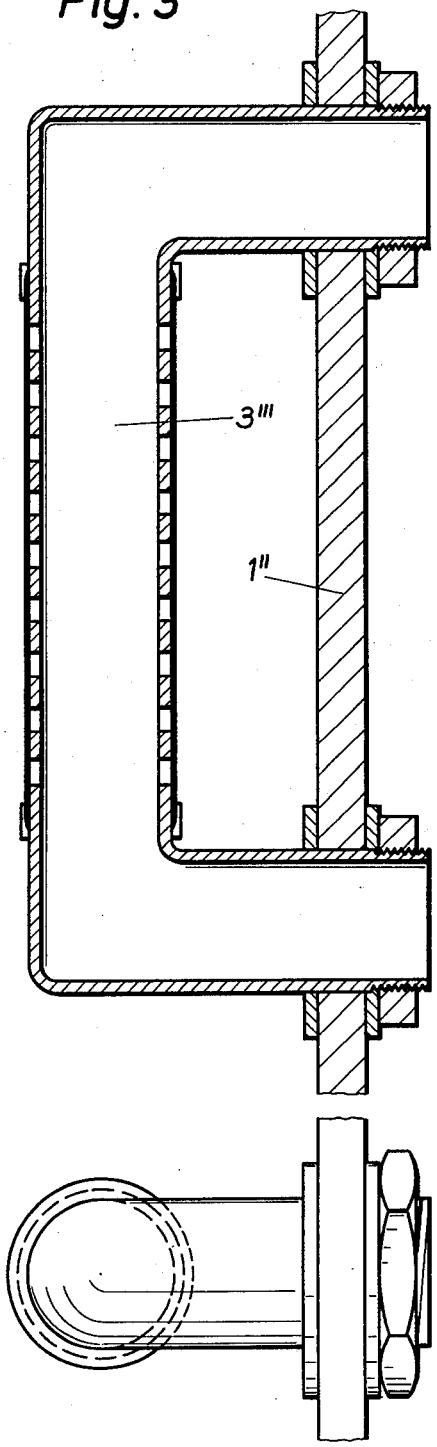
Fig. 4
Fig. 5
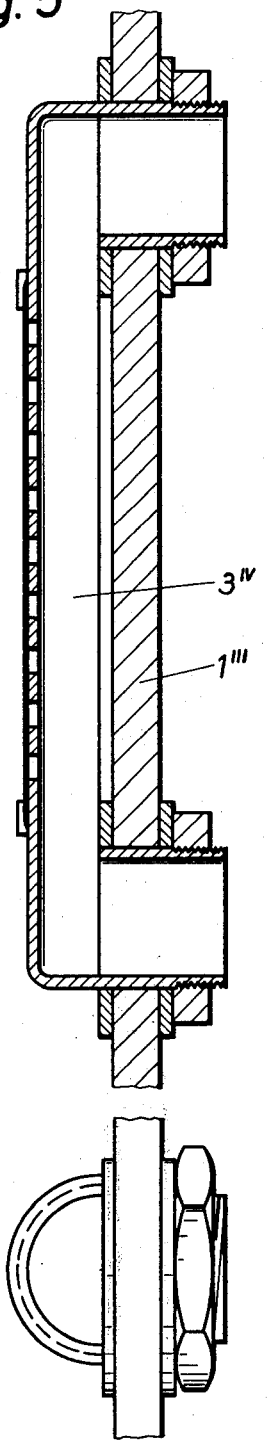
Fig. 6

PROCESS AND DEVICE FOR ELECTROPHORETICALLY PLATING METAL PARTS

The present invention relates to a process and device for electrophoretically plating metal parts with enamel in a plating container equipped with a hollow cathode.

Processes and devices are known from the art, in which the electrodes serving as cathodes are placed in separate cathode chambers, which have an overflow means arranged in the upper third of the chamber for the removal of water.

These separate cathode chambers are filled with a weak electrolyte; as soon as current is flowing between cathode and anode, cations of the slurry are moving with the excess water into the cathode chamber from where they are drained by the overflow. By this means, the amount of solids and the conductivity of the slurry are maintained at a constant level.

The device functions satisfactorily, but has the disadvantage that separate cathode chambers with overflow means are comparatively expensive. They also have the shortcoming that when the membrane, which covers the openings of the cathode chamber walls is damaged, the electrolyte may flow from the cathode chamber into the plating vessel.

Also known are electro-immersion varnishing processes and devices in which the separate cathode chambers are rinsed. In another known device, the liquid flowing through the membrane is withdrawn by a pump and delivered to a supplementary unit. In that unit, additional material is mixed with the withdrawn liquid and the mixture is again added to the plating bath. This is a desirable measure in electrophoretic varnishing, because it permits recovery of the solvent.

However, when electrophoretic plating is carried out with vitreous enamel, water is used as a suspension agent. Another factor to be considered is that in electrophoretic plating, the conductivity of the slurry is steadily increasing. This increase in conductivity is caused by the fact that electrolysis cannot be avoided in electrophoretic plating. The ions present in the slurry travel in accordance with their charge to the cathode or the anode. The anions travel, as do the suspended particles of the slurry, to the anodically poled work piece, and part of the anions are removed from the slurry by the plated workpiece. The cations travel to the cathode, where hydrogen is evolved during the plating.

Alkali ions or alkali earth ions are not removed from the slurry. Since fresh ions are constantly introduced into the bath with the additional slurry, the conductivity of the latter in the plating vessel will increase. This increase in conductivity leads, depending on the nature of the slurry, or on the quality demanded of the goods, to a useless slurry.

Surplus ions travel with the excess water into the hollow cathode and have to be removed therefrom. When the membrane is damaged, these ions are capable of returning from the hollow cathode to the plating vessel. This accumulation of ions causes a rise in the conductivity of the slurry which renders it useless. Since the volume of the plating is generally quite large, the damage caused by the useless slurry is considerable.

It is an object of the present invention to provide a process and device which will render it possible to avoid the drawbacks of the known processes and devices as discussed above.

It is another object of the invention to provide a process and device for electrophoretically plating metals with vitreous enamel in which, even with a damaged membrane, surplus ions will be positively prevented to enter the plating vessel from the hollow cathode.

According to the invention, the main feature for achieving the indicated object is the arrangement of a pump or drainage means which removes water from the hollow cathode almost completely. Another important feature of the invention is a drain pipe arranged in the bottom part of the hollow cathode.

In the following, the invention will be more fully explained with reference to the accompanying drawings, which illustrate several embodiments of the device according to the invention by way of example.

In the drawings wherein similar reference characters denote similar elements throughout the several views:

FIG. 3 illustrates in side view and section, a hollow cathode secured to the side wall of the container;

FIG. 4 is a top plan view of the hollow cathode of FIG. 3;

FIG. 5 shows in side view and in section, a hollow cathode of semicircular cross section; and FIG. 6 is a top plan view of the hollow cathode of FIG. 5.

Figure 1:
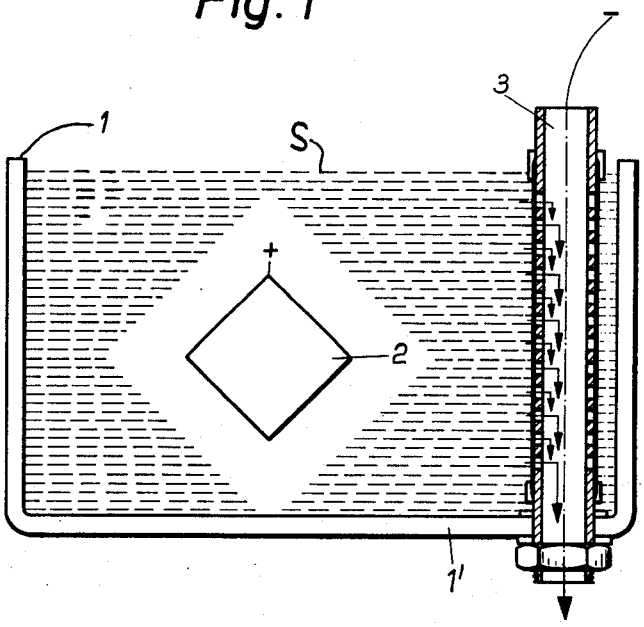
FIG. 1 is a side view, partly in section, of a plating vessel with a hollow cathode secured to the bottom.
Figure 2:
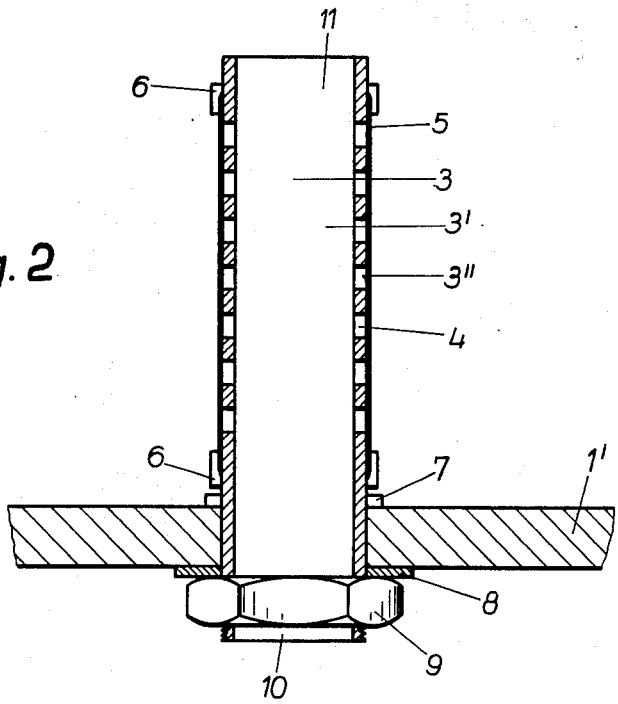
FIG. 2 shows the hollow cathode on an enlarged scale.

Referring now to FIG. 1, the plating vessel which consists of a non-conductor, e.g., plastic, is designated by numeral 1, the work piece by 2, and the hollow cathode by 3. There may be several cathodes arranged in the vessel. The bottom of vessel 1 is designated by 1'. As more fully shown in FIG. 2, cathode 3 is secured to bottom 1'. The plating vessel is filled with slurry, designated by S. According to FIG. 2, the interior 3' of the hollow cathode is connected to the outside 3'' by openings 4, which are covered by a membrane 5. The membrane is sealed at the top and at the bottom by gaskets 6. As mentioned before, the cathode is secured to the bottom 1'; the fastening means comprise a pressure plate 7, a disc 8, and a nut 9.

At the bottom, the cathode is provided with a drainage opening or overflow 10, and at the top with a vent 11. The vent is at a higher level than the top of the slurry bath.

During the electrophoretic plating operation with vitreous enamel, membrane 5 acts like a plurality of suspended particles. The membrane, which one can consider as a large number of small particles, sintered together, has the tendency of traveling to the anodically poled workpiece 2, as soon as a voltage is applied. However, since the particles of the membrane are immobile, they are prevented from moving. On the other hand, the water, which is in front of the membrane, has the tendency to travel to the cathode. Therefore, it penetrates through membrane 5 and flows through openings 4 into interior 3' and through the drainage opening 10 of holow cathode 3. The porosity of the membrane can be so chosen that it will only be permeable for water when charge is applied to the cathode and the anode.

This removal of water is an electrophoretic dehydration, which could also be called electrofiltration in aqueous medium. The hydrogen developed at hollow cathode 3 can escape through vent 11.

In the embodiments of FIGS. 3–6, hollow cathodes 3''' and 3$^{IV}$ are fastened to side walls 1'' and 1''', respectively, of the plating vessel. The cross section of cathode 3''' is circular, the one of 3$^{IV}$ semicircular.

Circular cathode 3''' can be made from a tube and is therefore especially inexpensive to manufacture. The semicircular hollow cathode 3$^{IV}$, on the other hand, is very space-saving since it closely lies against the side wall of the plating vessel.

Even if membrane 5 is damaged, no ions can be transported with the electrolyte from hollow cathode 3 into the plating vessel 1.

If desired, a pump can be provided outside of the plating vessel as a drainage means for the removal of water from the cathode.

While only a few embodiments of the present invention have been shown and described, it will be obvious that many changes and modifications may be made thereunto without departing from the spirit and scope of the invention.

What is claimed is:

1. A process for electrophoretically plating metal parts with vitreous enamel in a plating vessel filled with a slurry, said vessel containing a holow cathode whose interior is connected by openings with its outside, the openings being covered on the outside by a membrane, and draining means being provided for said cathode for practically completely removing water and other liquids from the interior of the same.

2. A device for electrophoretically plating metal parts with vitreous enamel, said device comprising a plating vessel for a slurry from which said vitreous enamel is to be deposited on a work piece forming the anode, a hollow cathode in said vessel firmly attached thereto and having openings for connecting the interior of the cathode with the outside thereof, a membrane for covering the outside of the openings, and drainage means for the cathode for withdrawing water and other liquids practically completely from the interior of the cathode.

3. The device according to claim 2 wherein the hollow cathode has a semicircular cross section and the flat side of the cathode is fastened to lie against the side wall of the plating vessel.

4. The device according to claim 2, wherein the drainage means is a pump with connecting means to the interior of the cathode.

5. The device according to claim 2, wherein the drainage means is an overflow at the bottom of the cathode.

6. The device according to claim 5, wherein the hollow cathode is formed by a tube, means for securing the tube to the bottom of the plating vessel, said outflow protruding beyond the bottom of the plating vessel.

7. The device according to claim 5 wherein the hollow cathode has a vent in the upper part which is located at a higher level than the level of the slurry.

8. The device according to claim 7, wherein the cathode is fastened to the side wall of the plating vessel, the outflow at the bottom of the cathode and the vent at the top being passed through the side wall, the outflow at the bottom of the cathode being arranged at a lower level than that of the slurry and the vent at the top at a higher level than that of the slurry.

* * * * *